US005536207A

United States Patent [19]

Robinson et al.

[11] Patent Number: 5,536,207

[45] Date of Patent: Jul. 16, 1996

[54] STATIC AIR MIXING APPARATUS

[75] Inventors: Keith D. Robinson, Wheatridge; Thomas A. Erikson, Lakewood, both of Colo.

[73] Assignee: Blender Products, Inc., Denver, Colo.

[21] Appl. No.: 358,850

[22] Filed: Dec. 19, 1994

[51] Int. Cl.[6] ..... F24F 13/04

[52] U.S. Cl. ..... 454/261; 454/269

[58] Field of Search ..... 454/261, 269

[56] References Cited

U.S. PATENT DOCUMENTS

| | | | |
|---|---|---|---|
| 3,180,245 | 4/1965 | Erikson, Jr. et al. | 454/269 |
| 4,495,858 | 1/1985 | Erikson . | |
| 5,127,878 | 7/1992 | Meckler et al. | 454/269 X |
| 5,364,305 | 11/1994 | Zieve | 454/261 |

FOREIGN PATENT DOCUMENTS

| | | | |
|---|---|---|---|
| 2005282 | 12/1993 | Russian Federation | 454/261 |
| 531000 | 10/1976 | U.S.S.R. | 454/261 |

*Primary Examiner*—Harold Joyce
*Attorney, Agent, or Firm*—Fields, Lewis & Rost

[57] ABSTRACT

A static air mixing apparatus for mixing of air passing through a space or duct. The apparatus includes an inner enclosure at least partially traversing the duct, an outer enclosure surrounding the inner enclosure, a first plurality of radial vanes extending outwardly from a center of the inner enclosure to adjacent the inner enclosure, a second plurality of radial vanes extending from between the inner and outer enclosures, and a transition member forming a divergent retention region downstream of the enclosures for prolonging mixing of different temperature airstreams as they pass through the air mixing apparatus. Further, the apparatus are derived from an optimized depth ratio between the depth of the enclosures to the minimum diameter of the outer enclosure of between 0.37 and 0.40 and core ratio between the core area defined by the inner enclosure to the outer enclosure area including the core area of between about 0.60 to about 0.65.

20 Claims, 4 Drawing Sheets

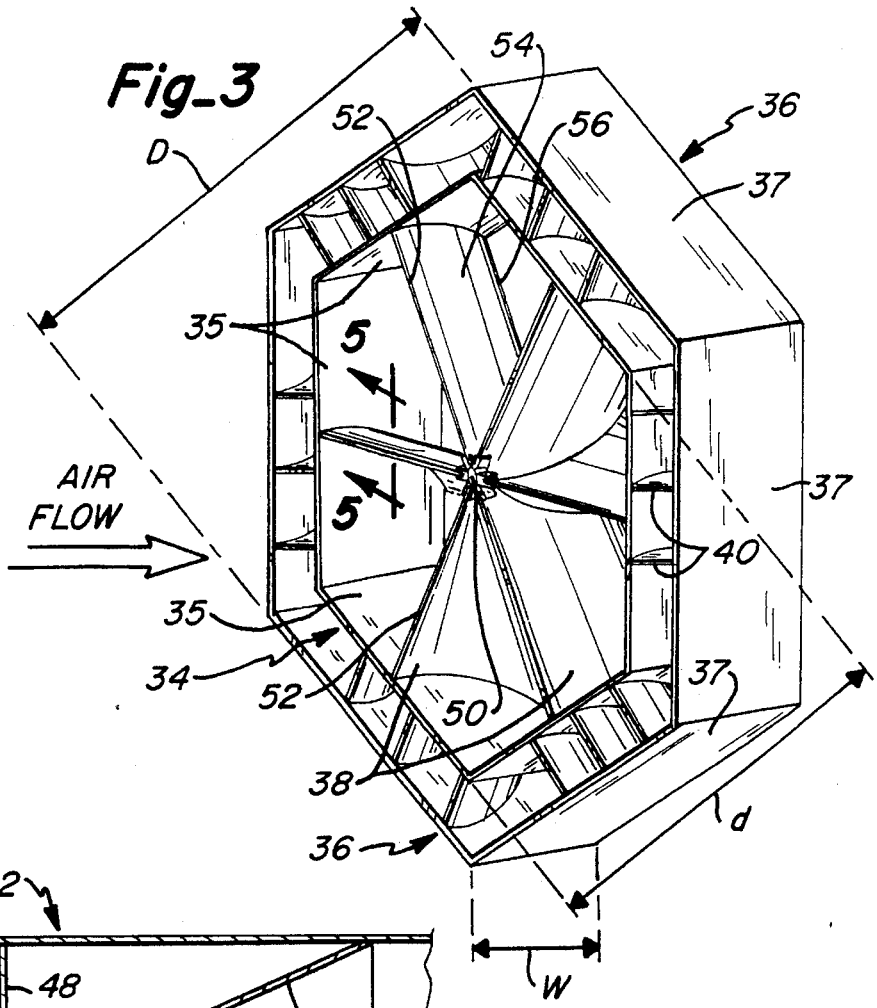
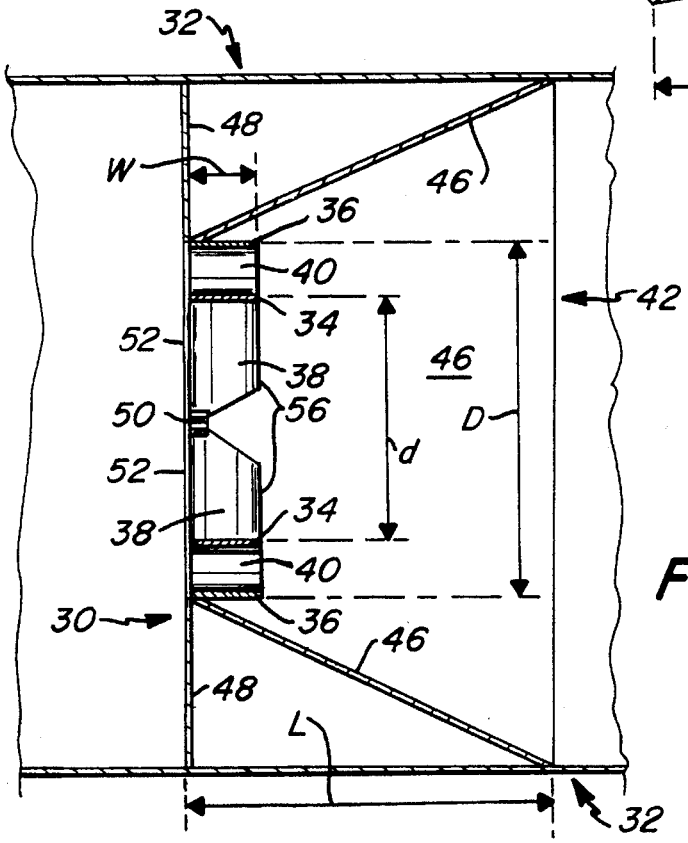
Fig_4

STATIC AIR MIXING APPARATUS

BACKGROUND AND FIELD OF INVENTION

This invention relates to heating, ventilating and air conditioning systems, and more particularly to a novel and improved air mixing apparatus for optimized mixing of air passing through a space or duct while maintaining a uniform velocity profile and minimum pressure drop.

Airstreams which are introduced at different temperature levels through a common duct in ventilating and air conditioning systems require intimate mixing in the duct in order to avoid undesirable stratification of the air prior to, for example, its passage into a room air space. The static mixing device disclosed in U.S. Pat. No. 4,495,858 and assigned to the assignee of this invention, when interposed in such a duct, effectively minimizes stratification of the different temperature airstreams in the duct.

An air mixing or blending apparatus installed in an air duct creates a pressure drop in the air flow across the blender during operation. This pressure drop is undesirable and therefore efforts to minimize the pressure drop is a main consideration in static air mixing design. In addition it is desirable to maximize the efficiency and effectiveness of the mixing that takes place immediately downstream of the mixing apparatus to achieve and to maintain a uniform velocity profile downstream of the mixing device. Conventional mixers have a mixing effectiveness typically less than 30% and at the most, about 38%. Therefore there is a need for development of a mixing apparatus which optimally mixes stratified airstreams of different temperatures while at the same time minimizing the pressure drop across the device and presents a relatively uniform velocity and temperature profile downstream of the apparatus.

SUMMARY OF THE INVENTION

It is therefore an object of the present invention to provide a novel and improved static air mixing apparatus having no moving parts which substantially eliminates stratification of airstreams passing through the apparatus.

It is another object of the invention to provide for a novel and improved air mixing apparatus which optimizes the mixing of different temperature airstreams passing through the mixing apparatus while minimizing pressure drop across the apparatus.

It is another object of the invention to provide an improved air mixing apparatus which has a divergent downstream transition to prolong turbulent mixing of airstreams thereby improving mixing effectiveness in the mixing apparatus. It is a further object of the invention to provide an improved air mixing apparatus having optimum ratios of depth to enclosure diameter to further maximize mixing and minimize pressure drop across the apparatus.

It is a further object of the invention to establish optimum area ratios in an air mixing apparatus having an inner core area of curved vanes directed in one rotational direction and an outer concentric set of curved vanes or blades around the inner core directed in the opposite rotational direction to optimize air mixing.

In accordance with the present invention, an air mixing apparatus has been devised which meets the aforementioned needs. The novel and improved air mixing apparatus in accordance with the invention is of the static type as disclosed in said U.S. Pat. No. 4,495,858 which has at least one enclosure partially traversing a duct and defining a core area therein containing a plurality of radial curved vanes. These vanes diverge away from a center of the enclosure and terminate at their outer distal ends at or adjacent to an outer wall of the enclosure. Among other features, the improved apparatus includes providing a downstream divergent transition between the enclosure of the air mixing apparatus and the walls of the duct to contain the turbulence and reduce the pressure drop across the blender. A second outer enclosure may surround the inner enclosure having another plurality of curved radial vanes spaced around the inner enclosure, providing a specific area ratio between the inner core vane area and the outer enclosure area which includes the inner core area, the ratio being between 0.55 and 0.65 and optimally about 0.62. Preferably, the depth ratio of an overall depth of the enclosure in the downstream direction to the outer enclosure diameter is between 0.30 and 0.50 and optimally about 0.38. A dual enclosure air mixing apparatus which incorporates all three of the above improvements has an improved overall mixing effectiveness of about 75%, which approaches twice that of conventional mixers currently available in the marketplace, such as, the mixer described in U.S. Pat. No. 4,495,858.

The above and other objects of the present invention will become more readily appreciated and understood from a consideration of the following detailed description of preferred and modified forms of the present invention when taken together with the accompanying drawings in which:

BRIEF DESCRIPTION OF THE DRAWINGS

FIG. 3 is a perspective view of the air mixing apparatus shown in FIG. 2 separated from the duct and its mounting board;

FIG. 4 is a longitudinal cross sectional view of the duct and air mixer shown in FIG. 2 taken along the line 4—4;

DETAILED DESCRIPTION OF PREFERRED EMBODIMENT

Figure 1:
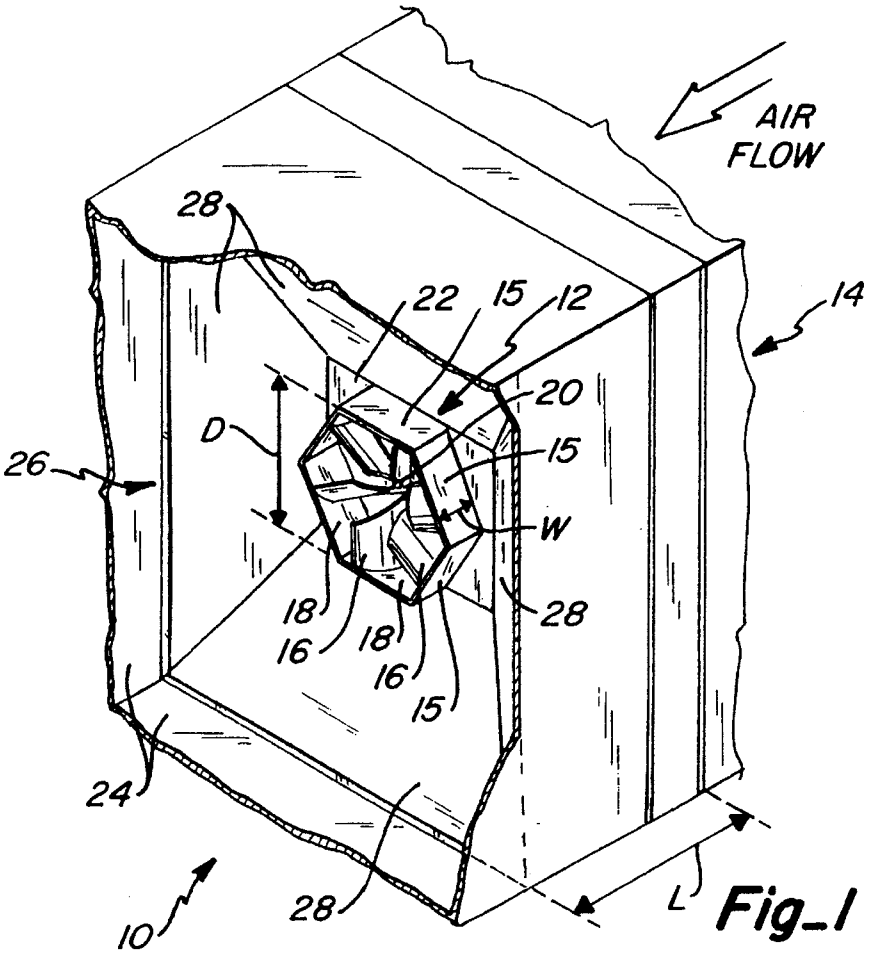
FIG. 1 is a perspective view of a duct which includes a first embodiment of the improved air mixing apparatus in accordance with the invention with portions of the duct wall broken away.

Turning now to the Drawings, a first embodiment of an air mixing apparatus 10 includes one enclosure 12 partially traversing a duct 14 and defining a core area therethrough and incorporating improvements in accordance with the present invention is shown in FIG. 1. The air mixing apparatus 10 is a static device which has no moving parts. The enclosure 12 is basically a hexagonal sleeve having six rectangular panel portions 15 joined in end-to-end relation to one another. The distance through the center of the enclosure 12 between opposing parallel panels 15 is the minimum diameter "D" of the enclosure 12.

The enclosure 12 carries a plurality of radially extending vanes 16 which diverge away from a center of the enclosure 12 and terminate at their outer distal ends at the inner wall surfaces 18 of the panels 15 of the enclosure 12. These vanes 16 are uniformly spaced and are curved in the same downstream direction to impart either clockwise or counterclockwise rotation to air passing through the mixing apparatus 10 and to create a swirling motion in the air whereby to mix the stratified airstreams.

The power required to cause the mixing in the air mixing apparatus 10 is generated by the pressure loss across the air mixing apparatus 10, which may be supplied by a system fan upstream or downstream (not shown) of the air mixing apparatus 10. The vanes 16 in the enclosure 12 are preferably joined together at a central hub 20 at the center of the enclosure 12, as shown in FIG. 1. Alternatively, they may be joined at the center of the enclosure 12 by spot welding them together or they may be entirely cantilever supported from the inner wall surfaces 18 of the panel portions 15 of the enclosure 12.

The enclosure 12 is supported in the duct 14 by a support plate 22 transversely mounted in the duct 14 so that all air passing through the duct 14 must pass through the air mixing apparatus 10. Extending downstream from the enclosure 12 to the duct walls 24 is a smooth transition member 26 in accordance with the present invention. The transition member 26 gradually expands the air mixing area downstream of the enclosure 12 to the duct walls 24 in order to reduce the pressure drop and prolong the mixing of the airstreams before continuing through the duct 14. The transition member 26 is comprised of a plurality of flat sheet metal plates 28 which are joined at their adjacent edges to form a gradual expansion region in the shape of a truncated pyramid diverging downstream of the enclosure 12 to the walls of the duct 14. This transition member 26 has a length L along the duct 14 which preferably corresponds to the minimum diameter of the enclosure 12, i.e. the distance between parallel panel portions 15 through the center of the enclosure 12.

The transition member 26 should optimally diverge downstream from the downstream end of the enclosure 12. However, this construction would require additional support structure and result in additional cost. Therefore, in the preferred form, each plate 28 of the transition member 26 extends downstream to the wall surface 24 of the duct 14 from the support plate 22 adjacent to the upstream end of the enclosure 12. The efficiency loss caused by this discontinuous origination of the transition member 26 is minimal.

Surprisingly, it has also been found that air mixing effectiveness is related to the depth ratio of the enclosure depth W along the duct 14, i.e. the length of the sleeve-shaped enclosure 12 to the minimum diameter D through the center of the enclosure 12. The optimum depth ratio of depth W to diameter D lies in a range of between about 0.25 and 0.40 and preferably between about 0.33 and 0.40 for this single enclosure embodiment shown in FIG. 1. The greatest mixing efficiency improvements have been found to exist at a depth ratio of about 0.38. However, the air pressure drop across the enclosure 12 becomes dominant at this ratio and therefore the optimum overall depth ratio is less, about 0.33.

Figure 2:
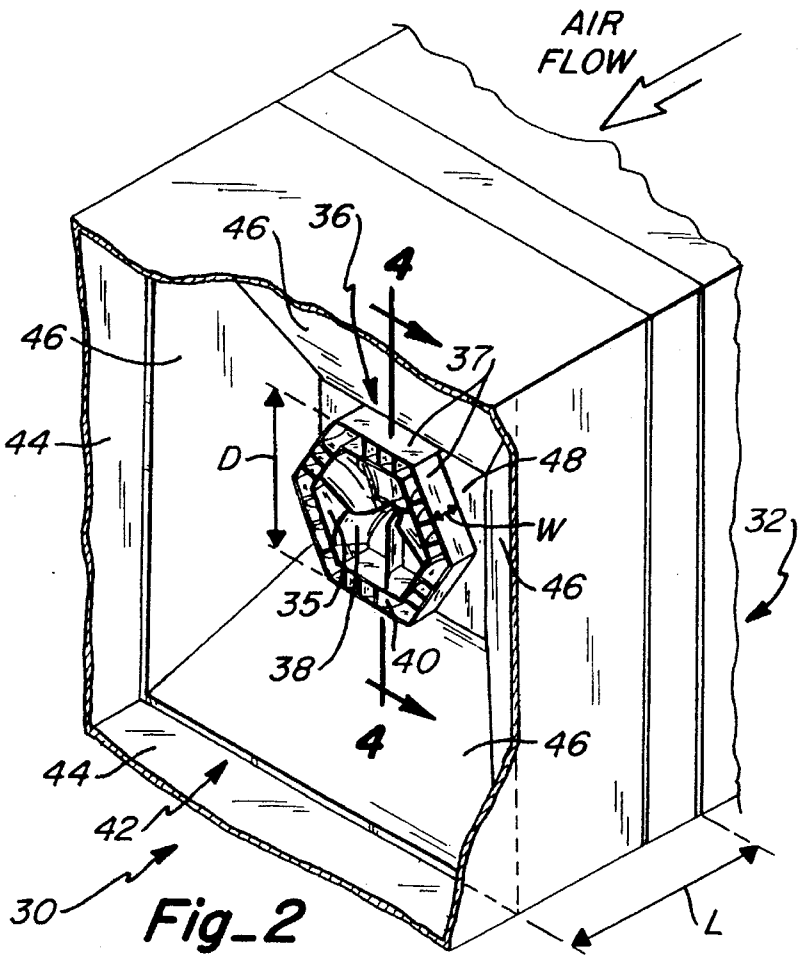
FIG. 2 is a rear perspective view as in FIG. 1 with a second embodiment of the mixing apparatus in accordance with the invention disposed therein.

A second preferred embodiment of an air mixing apparatus 30 in accordance with the present invention is shown mounted in a duct 32 in FIG. 2, separately in FIG. 3 and in section in FIG. 4. In this second embodiment, the air mixing apparatus 30 includes an inner enclosure 34 partially traversing the duct 32 defining a core area within the enclosure 34. The enclosure 34 is a hexagonal sheet metal sleeve having six identical flat rectangular panel portions 35 joined end-to-end. An outer hexagonal sleeve-shaped enclosure 36 surrounds, preferably concentrically, the inner enclosure 34 and defines a total outer enclosure area which includes the core area.

A first plurality of radially extending vanes 38 diverge away from a center of the inner enclosure 34 and terminate at their outer distal ends at the panel portions 35 of the inner enclosure 34. Each of these vanes 38 extends generally straight radially and is curved in the direction of air flow through the duct 32 so as to impart either a clockwise or counterclockwise rotation to air flow past the vane. A second set of radially extending vanes 40 are spaced between the inner and outer enclosures 34 and 36, around and outboard of the first plurality of vanes 38. Each of the vanes 40 radially extends straight outward from a panel portion 35 of the inner enclosure 34 and terminates at its distal end at a panel portion 37 of the outer enclosure 36. This second set of vanes 40 also curves in the downstream direction through the duct 32, but oppositely to the curvature of the first set of vanes 38 so as to impart an opposite directional rotation to the air passing by the second set of vanes. As a result, the counter-rotating, swirling flows of air passing through the mixing apparatus thoroughly mix downstream of the enclosures 34 and 36 as described in U.S. Pat. No. 4,495,858.

It has been found that the mixing effectiveness in this static mixing apparatus is greatly improved when the ratio of core area of the inner enclosure 34 to the total outer enclosure area is between 0.55 to about 0.65 Further, the preferred core area ratio has been found to be between about 0.60 and 0.63, with an optimum core area ratio of about 0.62.

The mixing efficiency of the mixing apparatus 30 is further improved by incorporating the improvements noted with respect to the first preferred embodiment. Specifically, the improved air mixing apparatus includes an outlet transition member 42 diverging downstream from the outer enclosure 36 to the walls 44 of the duct 32. See FIGS. 2 and 4. This transition member 42 provides a generally smooth expansion and retention region where the air exiting the enclosures 34 and 36 tends to remain and further mix prior to continuing travel downstream. Thus the transition member 42 provides an increased retention time of mixing airstreams further enhancing mixing and temperature equalization between the airstreams as well as to minimize the pressure drop across the enclosures 34 and 36.

The outlet transition member 42 preferably comprises a plurality of flat plates 46 joined at their adjacent edges to form a truncated rectangular pyramid shape diverging downstream of the enclosures 34 and 36 to the walls 44 of the duct 32. The transition member 42 preferably has its upstream origin at a support plate 48 which supports the outer enclosure 36 and directs all air flow through the duct 32 into either the inner or outer enclosures. The transition member 41 may be given a length L along the duct which is within a range of 0.8 and 1.5 times the minimum diameter D of the outer enclosure 36 and preferably is of a length substantially equal to the diameter D of the outer enclosure 36.

The inner and outer enclosures 34 and 36 are shown removed from the duct 32 in FIG. 3. In the illustrated embodiment, the enclosures each have a hexagonal sleeve shape made from a flat strip of rectangular sheet material, such as, sheet metal used in air conditioning duct work folded to create the six sides. The hexagonal enclosures could also be made of plastic or other sheet type stock. Further, the shape could also be octagonal, circular or any polygonal sleeve structure. However, a hexagonal or octagonal shape is preferred for ductwork installations.

Figure 5:
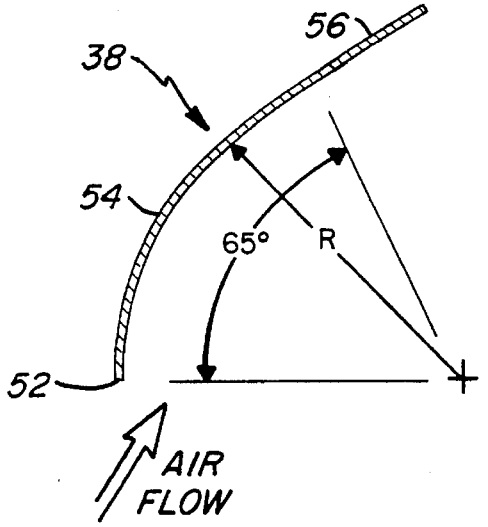
FIG. 5 is a cross sectional view of one of the vanes taken along the line 5—5 in FIG. 3.

Each of the vanes 38 extends radially outward in a straight line to the inner enclosure 34 from a central hub 50 at the center of the inner enclosure 34. In this embodiment, there are six vanes, one directed to each of the six rectangular panel sides of the inner enclosure 34, each spaced 60° apart. Each of the vanes 38 illustrated is curved downstream in a counterclockwise direction and has a cross-sectional shape as shown in FIG. 5. Each vane 38 is defined by a leading edge 52 radially extending normal or perpendicular to the air flow with a laterally curved portion 54 extending downstream in the direction of air flow away from the leading edge 52. The curved portion 54 scribes an arc of about 65° and continues into a straight trailing edge portion 56 which is disposed along its greater length in rearwardly spaced parallel relation to the leading edge 52. Between the inner enclosure 34 and the outer enclosure 36 there is a second set of vanes 40 each having approximately the same cross sectional shape as is shown in FIG. 5. These vanes 40 are equidistantly spaced in sets of two or three in each of the six segments of the hexagonal ring formed between the inner enclosure 34 and the outer enclosure 36. These vanes 40 are oriented so as to direct the air flow in the opposite rotational direction to the air flow past the inner set of vanes 38. Thus in FIG. 3, vanes 40 direct air flow in a clockwise rotation about the axis through the duct 32.

Figure 6:
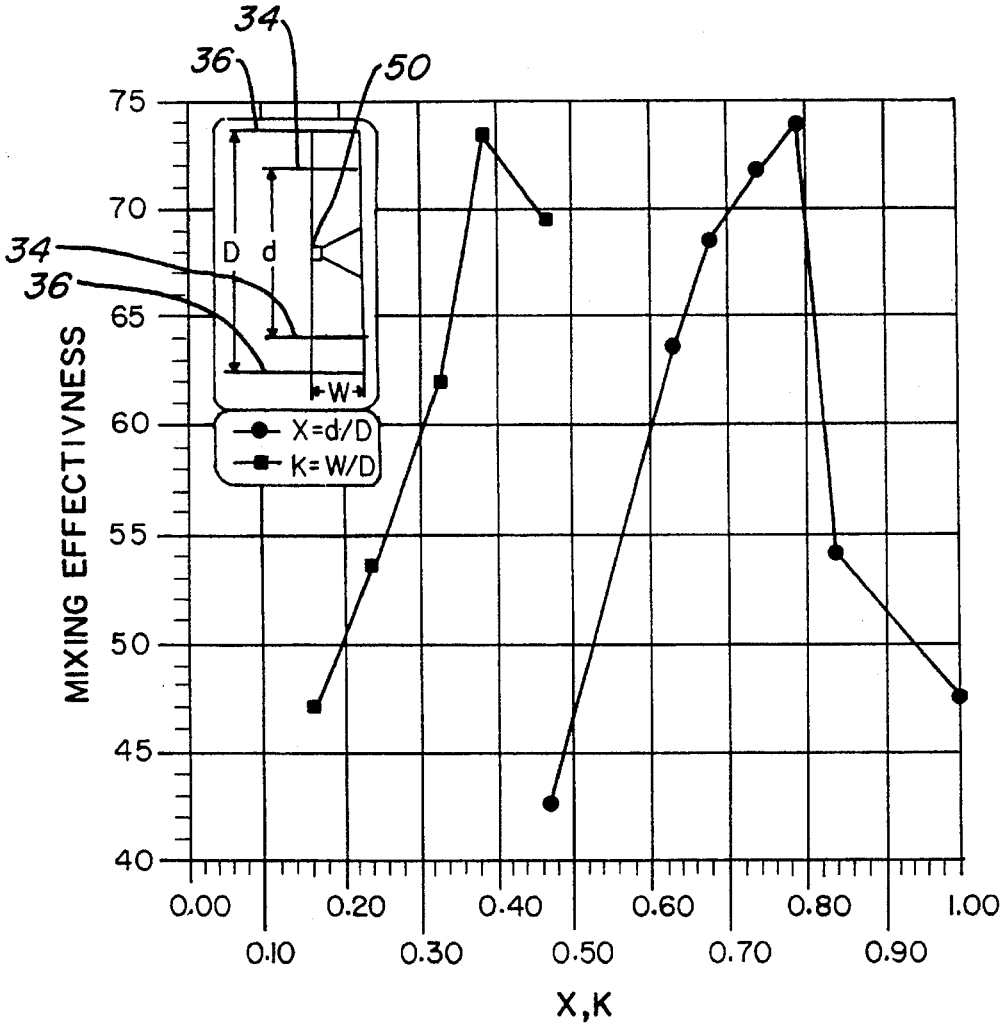
FIG. 6 is a graph of depth ratio and core area ratio versus mixing effectiveness for various sizes of the air mixer shown in FIGS. 2 and 3.

The ratio of the inner core area to the outer enclosure area has surprisingly been found to be an important factor in overall mixing effectiveness. This is best shown in FIG. 6. FIG. 6 is a graph of mixing effectiveness for various enclosure size combinations. Each mixing apparatus plotted in FIG. 6 has an outer enclosure minimum diameter "D" of 38 inches. The ratios of minimum diameters d/D for the inner versus outer diameters, respectively, are indicated along the horizontal axis. This ratio corresponds to the square roots of the core area ratios. The solid dots in the right portion of the graph of FIG. 6 represent the measured effectiveness versus the square root of the core area ratios for different sizes of mixers. It was found that a d/D ratio of 0.78, corresponding to a core area ratio of 0.62, yielded an optimum mixing effectiveness of about 78%. This is a significant improvement in mixing effectiveness when compared to a conventional dual enclosure mixing apparatus. The presently marketed conventional mixer, for example, as described in prior U.S. Pat. No. 4,495,858, has a d/D ratio of about 0.47, i.e. a core area ratio of 0.23, which corresponds to a mixing effectiveness of about 43%.

Another improvement is best illustrated with the aid of FIG. 4 and again FIG. 6. It was found that varying the depth W of the enclosures 34 and 36 significantly affected mixing effectiveness of the air mixing apparatus 30. The length of the enclosures 34 and 36 in the direction of air flow through the duct 32 is represented by the depth dimension letter W as shown in FIG. 4. The depth ratio is defined as the ratio (W/D) between the depth W and the minimum diameter D of the outer enclosure. The connected "x"s on the left portion of the graph in FIG. 6, is a plot of measured mixing effectiveness versus the various depth (W/D) ratios for different mixers. It was discovered that there is an optimum depth ratio for any mixer and therefore an optimum depth for any given outer enclosure size. This optimum was determined to be a depth ratio generally between 0.25 and 0.35, and preferably 0.30. When these optimum core area ratios and depth ratios are combined with an outlet transition member 42 as above described in an air mixing apparatus 30, the result is an improved air mixing apparatus with a very substantial mixing effectiveness increase, about twice the overall mixing effectiveness of a conventional static air mixing apparatus such as is described in U.S. Pat. No. 4,495,858.

Figure 7:
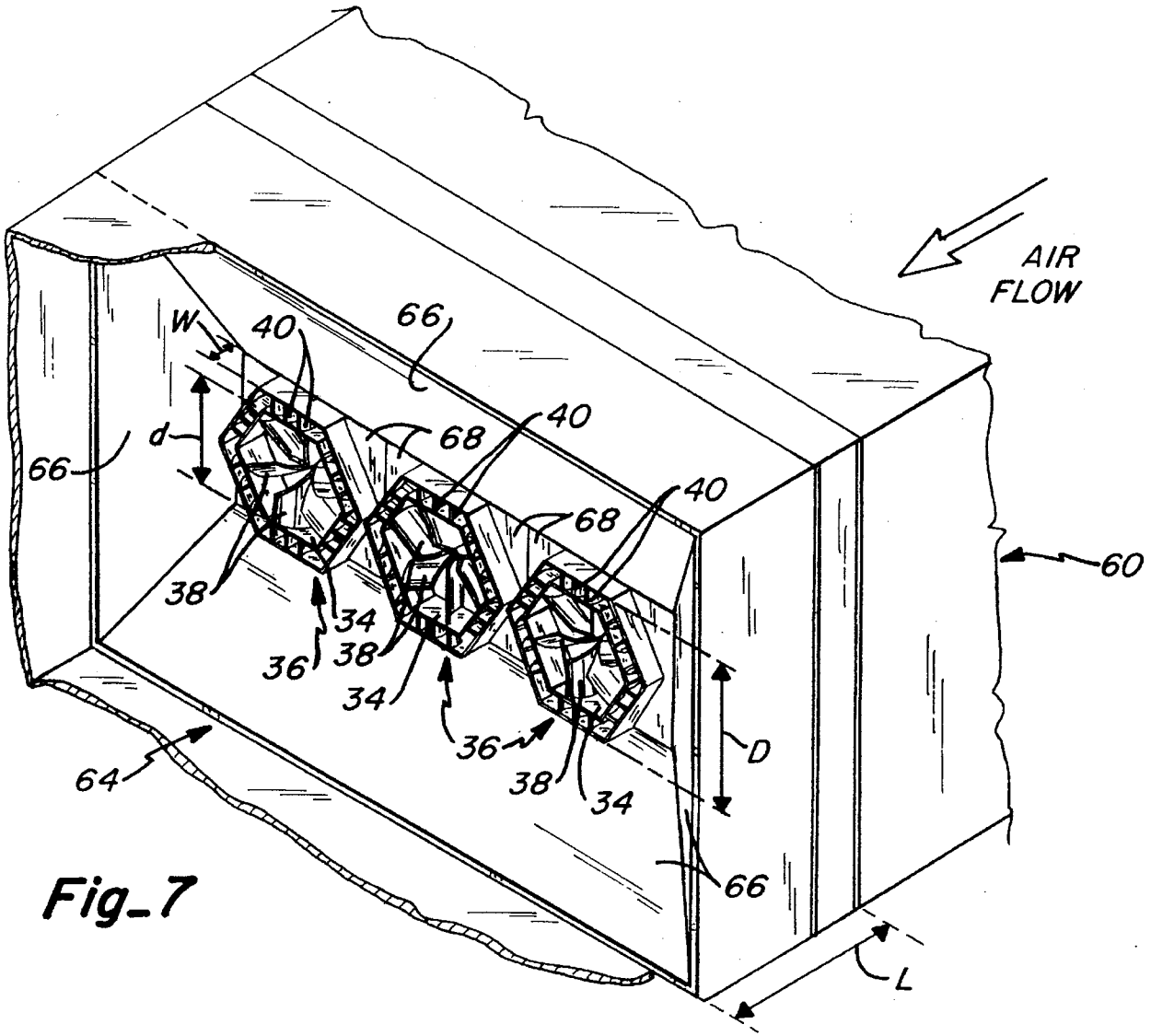
FIG. 7 is a perspective view of a duct having a rectangular cross-section with portions broken away to reveal a series of three air mixers as shown in FIG. 3 disposed in side-by-side relation.

The increase in mixing effectiveness is equally effective in duct installations in which a series of air mixing apparatuses are housed side-by-side. In particular, FIG. 7 illustrates a third preferred embodiment of the improved air mixing apparatus of the invention. This embodiment includes a series of outer enclosures 36 arranged side-by-side transversely across the wider dimension of a rectangular duct 60. Each of these enclosures 36 encloses an inner enclosure 34 and first and second sets of vanes 38 and 40, respectively, as above described. The transition member 64 again is a plurality of flat plates 66 which have their origins at an upstream support plate 68 which supports the outer enclosures 36 and directs all air flow through the enclosures 34 and 36. The flat plates 66 each terminate against the walls of the duct 60 downstream of the enclosures 36. The transition member 64 preferably has a length along the duct within a range of between about 0.8 and 1.5 times the minimum diameter D of the outer enclosure 36 and preferably about the same as the minimum diameter D of the outer enclosure 36.

While the present invention has been described in its application to mixing of two temperature airstreams, it is conformable for use in virtually any application for mixing air or gaseous streams and combinations of the same. In addition, the apparatus may be constructed other than as specifically described. For example, the enclosures need not be hexagonal. They may also be made octagonal or circular. The enclosures and vanes may also be made of separate plastic parts or molded as a single body. Further, different combinations of enclosure sizes may be utilized across a given duct. The transition members 26, 42 or 62 may also be formed from a single piece of sheet metal curved or bent to form a smooth, divergent, truncated cone shape diverging to the duct walls from the downstream end of the outer enclosures.

It is therefore to be understood that while a preferred forms of invention have been set forth and described herein, various modifications and changes will become apparent to those skilled in the art without departing from the spirit and scope of the present invention as defined by the appended claims. All patents, patent applications and publications referred to herein are hereby incorporated by reference in their entirety.

I claim:

1. An air mixing apparatus adapted for intermixing airstreams of different temperatures flowing through a common duct having walls defining a passageway, said apparatus comprising:

at least one enclosure partially traversing said passageway defining a core area;

a plurality of radially extending vanes diverging away from a center of said one enclosure and terminating at their outer distal ends adjacent to said enclosure; and an outlet transition member diverging downstream from said enclosure to the walls of said duct to increase the retention time of mixed airstreams passing through said core area to further enhance mixing and temperature equalization, said outlet transition member extending downstream a distance along said duct of between 0.8 and 1.5 times a minimum diameter of said enclosure.

2. The apparatus according to claim 1, wherein said outlet transition member comprises a plurality of flat plates joined together at adjacent edges.

3. The apparatus according to claim 1, further comprising a plurality of said one enclosures in side by side relation, said transition member diverging downstream from said enclosures to the walls of said duct.

4. The apparatus according to claim 1, wherein said at least one enclosure has a depth ratio of a depth dimension W of the enclosure in the direction of airstream flow through said duct to the minimum diameter D through said center of said enclosure of between about 0.25 and 0.40.

5. The apparatus according to claim 4, wherein said depth ratio is between about 0.25 and 0.40 inches.

6. The apparatus according to claim 5, wherein said depth ratio is between about 0.33 and 0.40.

7. An air mixing apparatus adapted for intermixing airstreams of different temperatures flowing through a common duct having walls defining a passageway, said apparatus comprising:

an inner enclosure partially traversing said passageway defining a core area;

an outer enclosure surrounding said inner enclosure defining an outer area;

a first plurality of radially extending vanes diverging away from a center of said inner enclosure and terminating at their outer distal ends adjacent to said inner enclosure;

a second plurality of radially extending vanes spaced around said first plurality of vanes, said second plurality of vanes diverging away from said inner enclosure and terminating at their outer distal ends adjacent said outer enclosure; and an outlet transition member diverging downstream from adjacent to said outer enclosure to the walls of said duct to increase the retention time of mixed airstreams passing through said core and outer areas to further enhance mixing and temperature equalization, said outlet transition member extending downstream a distance along said duct of between 0.8 and 1.5 times a minimum diameter of said outer enclosure.

8. The apparatus according to claim 7, wherein said outlet transition member comprises a plurality of wall portions joined together at adjacent edges so as to be of a generally pyramidal configuration.

9. The apparatus according to claim 8, wherein said wall portions of said outlet transition member comprise a plurality of flat plates.

10. The apparatus according to claim 7, wherein said apparatus has a ratio of said core area to said outer area of between about 0.55 and 0.65.

11. The apparatus according to claim 10, wherein said apparatus has a ratio of said core area to said outer area of between about 0.60 and 0.65.

12. The apparatus according to claim 7, wherein said outer enclosure has a depth ratio of depth dimension W of the outer enclosure in the direction of airstream flow through said duct to the minimum diameter D through said center of said outer enclosure of between about 0.25 and 0.40.

13. The apparatus according to claim 12, wherein said first and second plurality of vanes have said depth dimension W in the direction of airstream flow through said duct.

14. The apparatus according to claim 13, wherein said inner enclosure has said depth dimension W in the direction of airstream flow through said duct.

15. An air mixing apparatus adapted for intermixing airstreams of different temperatures flowing through a common duct having walls defining a passageway, said apparatus comprising:

a plurality of inner enclosures in side-by-side relation to one another each partially traversing said passageway and defining a core area therein;

a plurality of outer enclosures in side-by-side relation to one another each substantially surrounding one of said inner enclosures, each defining an outer area therein including said one core area;

each of said inner enclosures having a first plurality of radially extending vanes diverging away from a center of said inner enclosure and terminating at their outer distal ends adjacent to said respective inner enclosure;

each of said outer enclosures having a second plurality of radially extending vanes spaced around said first plurality of vanes, said second plurality of vanes diverging away from said inner enclosure and terminating at their outer distal ends adjacent to said respective outer enclosure; and an outlet transition member diverging downstream from an outer periphery said outer enclosures to the walls of said duct to increase the retention time of mixed airstreams passing through said core and outer areas to further enhance mixing and temperature equalization, said transition member extending downstream a distance along said duct of between 0.8 and 1.5 times a minimum diameter of said outer enclosures.

16. The apparatus according to claim 15, wherein said apparatus has a core ratio of said core area to said outer area of between about 0.55 and 0.65.

17. The apparatus according to claim 16, wherein each of said outer enclosures has a depth ratio of a depth dimension W in the direction of air flow through said mixing apparatus to a minimum diameter D of said outer enclosure through said center of between 0.25 and 0.35.

18. The apparatus according to claim 17, wherein said depth ratio is about 0.3.

19. The apparatus according to claim 15 wherein said inner and outer enclosures each has a polygonal shape.

20. The apparatus according to claim 15, wherein said transition member extends downstream a distance of about said minimum diameter of said outer enclosure.

* * * * *